US006116759A

United States Patent [19]

Smith

[11] Patent Number: 6,116,759

[45] Date of Patent: Sep. 12, 2000

[54] ADJUSTABLE ARMORED LIGHT FIXTURE WITH ADJUSTABLE REFLECTOR

[75] Inventor: Charles C. Smith, Baton Rouge, La.

[73] Assignee: Scientific Operating Systems, Inc., Addison, Tex.

[21] Appl. No.: 09/209,876

[22] Filed: Dec. 11, 1998

[51] Int. Cl.[7] ..... F21V 15/00

[52] U.S. Cl. ..... 362/376; 362/277; 362/306; 362/319; 362/341; 362/373; 362/294; 362/285; 362/802

[58] Field of Search ..... 362/376, 277, 362/306, 319, 341, 362, 373, 294, 263, 264, 285, 802

[56] References Cited

U.S. PATENT DOCUMENTS

| | | | |
|---|---|---|---|
| 4,150,422 | 4/1979 | Peralta et al. | 362/218 |
| 4,438,484 | 3/1984 | Winden | 362/267 |
| 4,441,143 | 4/1984 | Richardson, Jr. | 362/183 |
| 4,453,202 | 6/1984 | Morris et al. | 362/147 |
| 4,999,749 | 3/1991 | Dormand | 362/153.1 |
| 5,075,833 | 12/1991 | Dormand | 362/376 |
| 5,357,413 | 10/1994 | Mandall | 362/300 |
| 5,845,988 | 12/1998 | Mandall | 362/376 |

*Primary Examiner*—Sandra O'Shea
*Assistant Examiner*—Ronald E. DelGizzi
*Attorney, Agent, or Firm*—Sieberth & Patty, L.L.C.

[57] ABSTRACT

A armored light fixture which comprises an armored housing which defines an upper passageway through which light may pass, at least one lamp disposed within the armored housing, at least one reflector structure which is adjustable in position and which is disposed above the armored housing to enable the adjustable reflection of light which passes through the upper passageway of the armored housing.

20 Claims, 4 Drawing Sheets

ADJUSTABLE ARMORED LIGHT FIXTURE WITH ADJUSTABLE REFLECTOR

TECHNICAL FIELD

The present invention relates to armored or otherwise vandal-resistant light fixtures.

BACKGROUND

Although a blessing to their intended beneficiaries, man-made sources of light often are an annoyance for the would-be vandal or thief. As one might expect, therefore, light fixtures long have been targeted for destruction by vandals, thieves, and others seeking to reduce the amount of light present in a given locale. Light bulbs and lamps contained within the housings of such fixtures are typically fragile in construction, and severe jarring to merely a portion of such a fixture can destroy the bulb or lamp contained therein, thereby extinguishing the light emitted by the fixture. Attempts have been made to address this problem for those seeking to maintain the functional status of such light sources. For example, U.S. Pat. No. 5,357,413 to Mandall discloses an armored light fixture which has an armored housing and a reflector unit for reflecting light emitted from the housing. However, the rigidity of known vandal-resistant light fixtures inhibit the user's ability to adjust the light pattern cast by such fixtures or to easily replace parts which may be damaged during acts of vandalism.

Thus a need continues to exist for a light fixture which resists the attempts of vandals, would-be thieves and the like to destroy the fixture or extinguish the light emitted thereby, but which does not restrict the direction of light emitted from the fixture and which does not require additional structure which may become damaged from excessive jarring or sudden impact from flying objects. A need also exists for such a light fixture which includes parts which may be easily replaced if they are damaged as a result of an act of vandalism.

SUMMARY OF THE INVENTION

The present invention is deemed to fulfill these needs in a highly efficient way by providing, among other things, an armored light fixture which comprises (a) an armored housing which defines an upper passageway through which light may pass, (b) at least one lamp disposed within the armored housing, and (c) at least one reflector structure which is adjustable in position and which is disposed above the armored housing to enable the adjustable reflection of light which passes through the upper passageway of the armored housing. As used in the description of this invention, including the appended claims, it should be understood that "adjustable reflection" means that the direction of light reflection may be changed. It also should be understood that "armored" as used in the description of this invention, including the appended claims, means formed from bullet or otherwise vandal-resistant material, and is not limited to armor plate but can also include synthetic composite materials, e.g., plastics, glass, or composites including woven fabrics such as Kevlar® products marketed by E. I. du Pont de Nemours and Company, which are bullet- or otherwise vandal-resistant. The armored housing preferably comprises a side wall portion and a bottom portion, the side wall portion defining the upper passageway and being configured to receive a lamp cover lens which may be disposed across the upper passageway and above the lamp. It is also preferred that the lamp have an imaginary longitudinal axis which is substantially horizontally disposed when the fixture is installed, and that the position of the lamp be adjustable so that the lamp is rotated about an imaginary vertical axis which is substantially perpendicular to the longitudinal axis when the fixture is installed.

In another embodiment of this invention, an armored light fixture is provide which comprises (a) an armored housing comprised of a side wall portion and a bottom portion, the side wall portion defining an upper passageway through which light may pass and being configured to receive a lamp cover lens which may be disposed across the upper passageway and above the lamp, (b) at least one halogen lamp disposed within the armored housing, the spacial position of the lamp within the armored housing being adjustable, (c) at least one reflector structure disposed above the armored housing and having an imaginary longitudinal axis, the reflector structure being adjustable so that the imaginary longitudinal axis may be longitudinally aligned with an imaginary longitudinal axis of the lamp to enable the adjustable reflection of light which passes through the upper passageway of the armored housing; (d) a photocell for controlling the flow of electricity to the lamp based upon the amount of ambient light which is present; and (e) shielding means for shielding the photocell from one or more flying objects while concurrently permitting ambient light to reach the photocell.

These and other embodiments and features of the invention will become still further apparent from the ensuing description, appended claims and accompanying drawings.

BRIEF DESCRIPTION OF THE DRAWINGS

In each of the above figures, like numerals and/or letters are used to refer to like parts among the several figures.

DETAILED DESCRIPTION OF THE INVENTION

As may now be seen, this invention provides a highly efficient light fixture which provides light while also providing the added security of deterrence to the would-be thief or vandal seeking to act out under low ambient light conditions. Further still, the fixture has the added feature of enabling the user to select the direction and pattern of light emitted by the fixture without compromising the deterrence capabilities of the fixture, while also enabling the user to easily replace components of the device which may be damaged during acts of vandalism.

Figure 1:
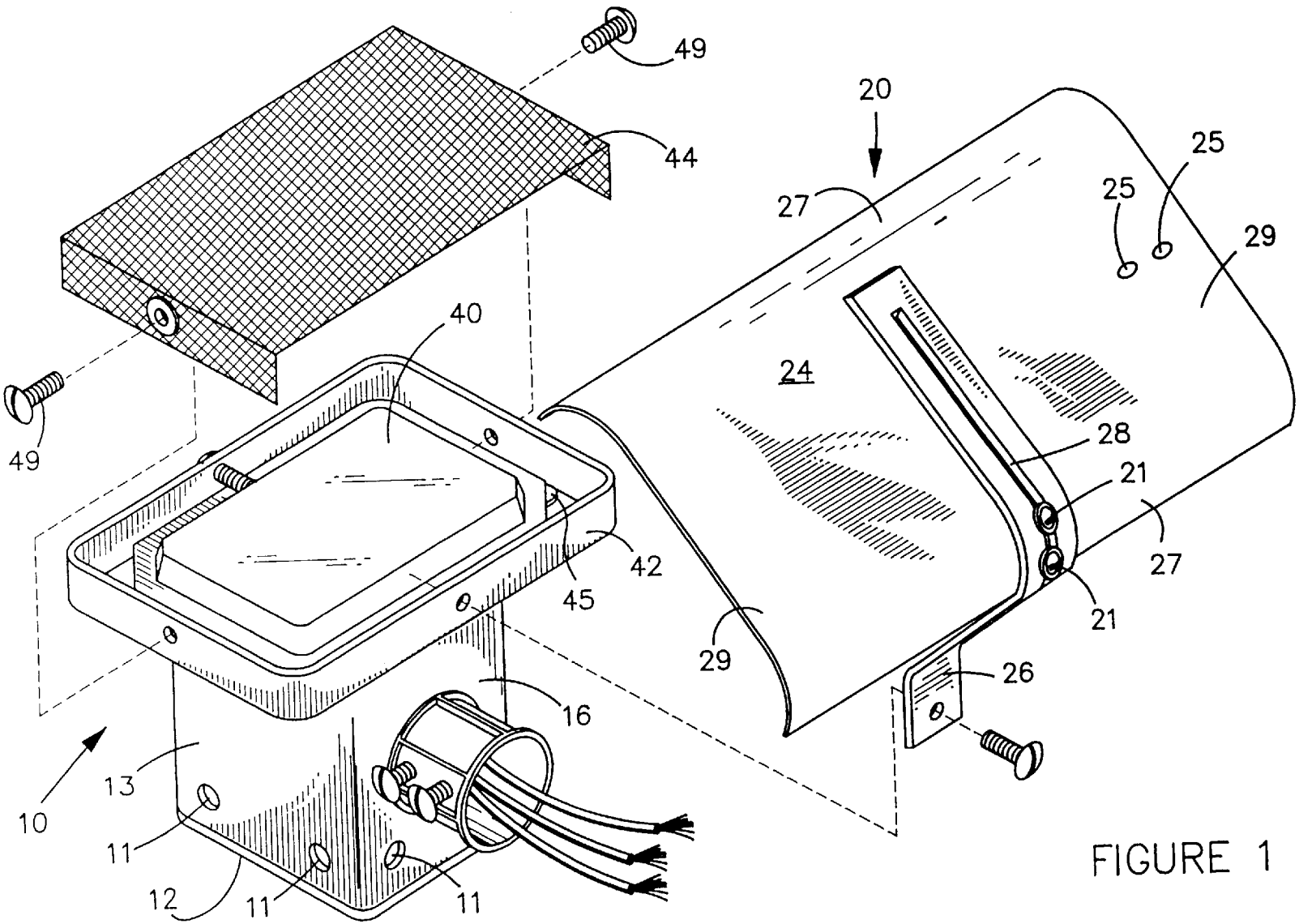
FIG. 1 is an exploded and elevated view in perspective of a preferred embodiment of this invention.

Referring now to the accompanying drawings, FIGS. 1–6 illustrate one preferred embodiment of this invention comprised of an armor plate housing 10, a reflector structure 20, and a halogen lamp 30. While use of inert gas lamps is preferred in the fixture because of the resiliency of such lamps, halogen lamps being particularly preferred, it will be appreciated that the lamps used may alternatively be any conventional high intensity lamp, e.g., an incandescent lamp. Housing 10 is comprised of a bottom portion 12 and a side wall portion comprised of four side walls 13, 14, 15, and 16. Side walls 13, 14, 15, and 16 define an upper passageway 18 which in FIG. 1 is covered by a glass lens cover 40. Lens cover 40 is seated above passageway 18 within a seat defined by housing 10 by way of a surrounding armor flange 42 and two armor brackets 43 and 45, flange 42 and brackets 43 and 45 being connected to side walls 13, 14, 15, and 16 and serving to protect lens cover 40 from flying objects, e.g., bullets. Flange 42 and brackets 43 and 45 of housing 10 also define a plurality of apertures 47 over which a portion of cover 40 extends, so that the interior of housing 10 is in sufficient fluid communication with the exterior to enable heat generated within housing 10 to circulate out of housing 10 through apertures 47. Housing 10 also includes a plurality of apertures 11 extending through side walls 13, 14, 15, and 16 which enable cooler air exterior to housing 10 to circulate into housing 10 as warmer air within housing 10 circulates around cover 40 and out of housing 10 through apertures 47. In this way, apertures 47 and 11 provide passageways which enable ventilation of heat buildup which might occur within housing 10 during periods of extended use of lamp 30.

Figure 3:
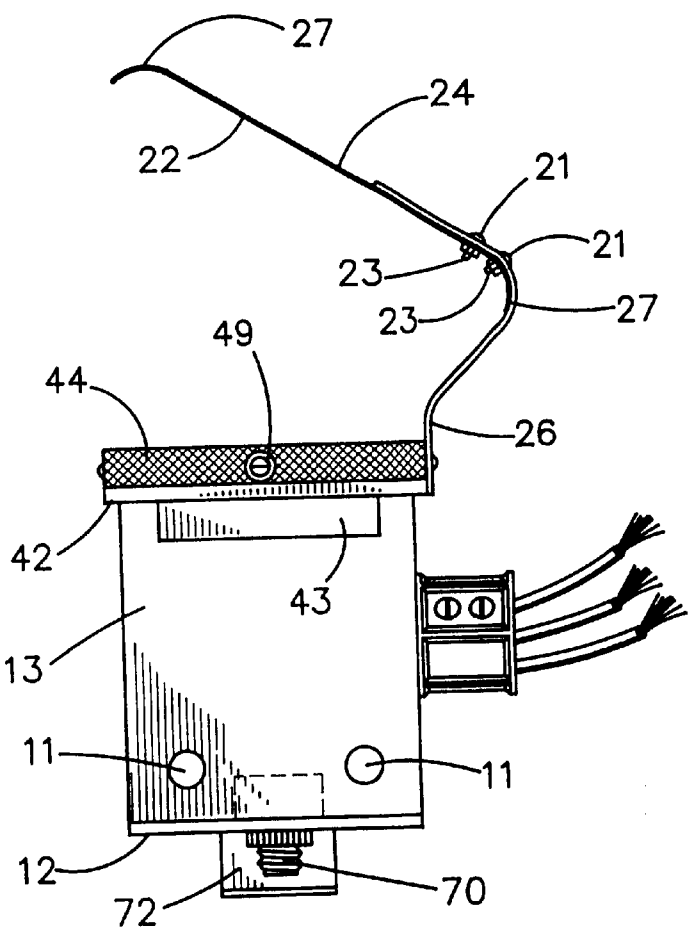
FIG. 3 is another side view partially in phantom of the device of FIG. 1.

With particular reference to FIGS. 1 and 3, it may be seen that a protective metal screen 44 which is sized and configured to fit above lens cover 40 is also provided in a preferred device of this invention. Screen 44 is attached to flange 42 by way of a plurality of screws 49, and serves to permit light to pass through the lens cover 40 to reflector structure 20 while also providing an added measure of protection to lens cover 40 from flying objects.

Figure 5:
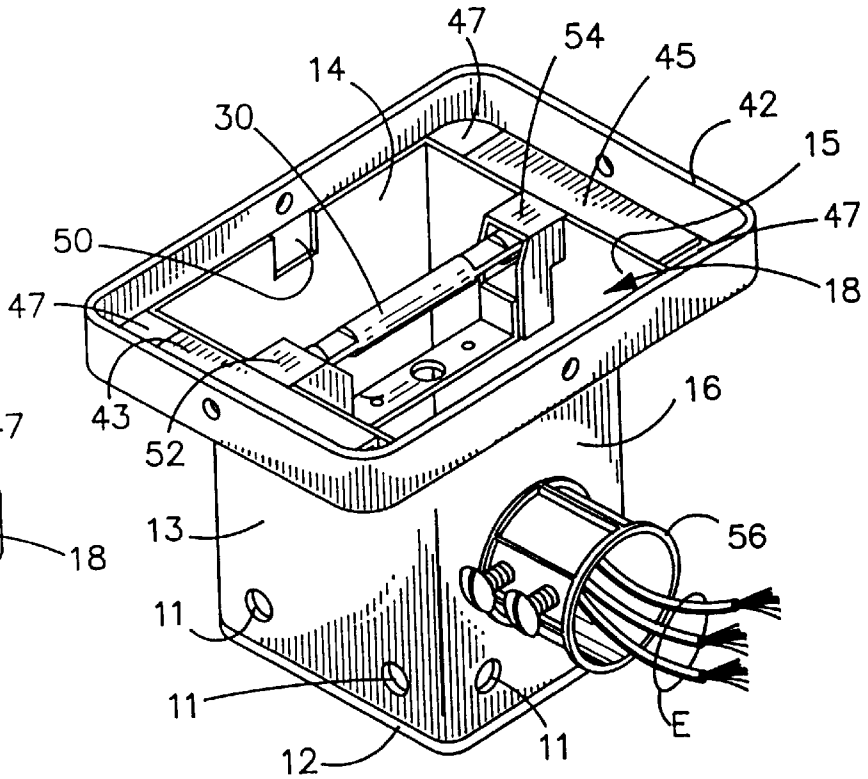
FIG. 5 is an elevated view in perspective of a portion of the device of FIG. 1.
Figure 6:
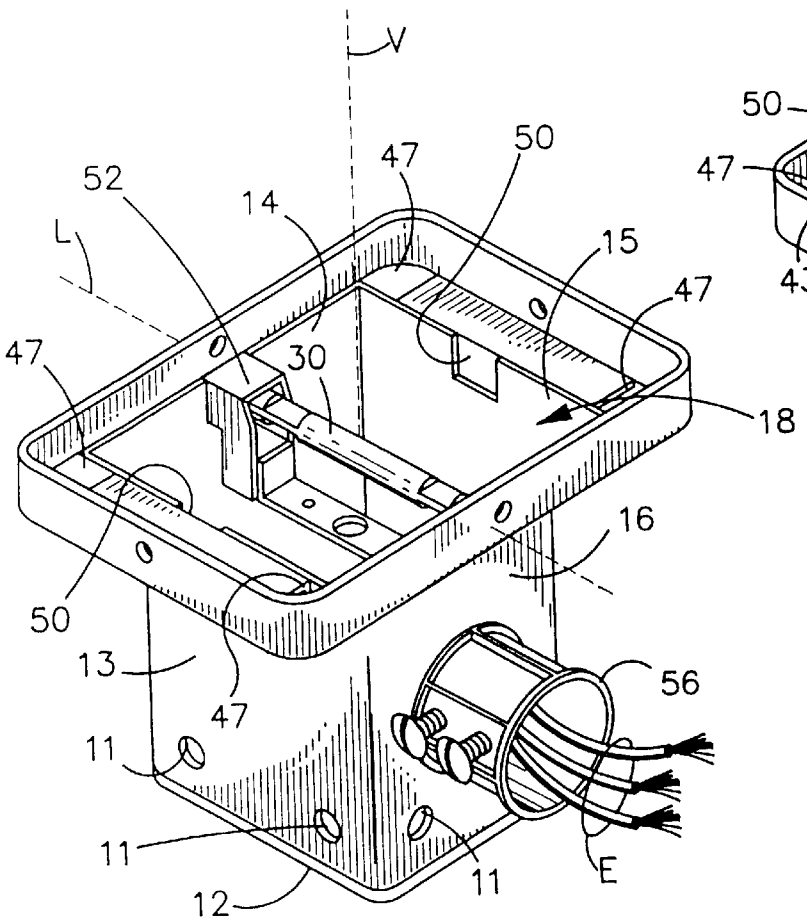
FIG. 6 is another elevated view in perspective of the portion of FIG. 5 illustrating a different position for one of the internal components thereof.

As may be seen in FIGS. 5 and 6, each of side walls 13, 14, 15, and 16 includes a respective notch 50 which is sized to receive an electrical socket 52 capable of receiving one end of lamp 30.

A second electrical socket 54 is received by notch 50 on the side wall opposite that receiving socket 52. Since sockets 52 and 54 are removable, their location may be changed to different sockets so that the spacial position of lamp 30 may be adjusted by rotation about an imaginary vertical axis V which is perpendicular to an imaginary longitudinal axis L of lamp 30. Compare in this regard the position of lamp 30 in FIG. 5 with the position of lamp 30 in FIG. 6. As may be appreciated from the figures, axis L is substantially horizontally disposed when the device is installed, and axis V is substantially vertically disposed when the device is installed. Electrical and grounding wires E extend from sockets 52 and 54 and through a cylindrical joint 56 in side wall 16. In the preferred embodiment depicted, a photocell 70 also is provided to control the supply of electricity to lamp 30. Photocell 70 extends through housing 10 and is protected by shielding means in the form of an armor plate flange 72 which extends from housing 10 so as to shield photocell 70 from projectiles while permitting ambient light to reach the photocell. Other shielding means may be employed as long as the shielding means enables ambient light to reach the photocell. Non-limiting examples of other suitable shielding means include bullet-resistant, transparent materials such as plastic or glass having such characteristics. Joint 56 is configured for clamping attachment to an appropriately wired pole or other support structure (not shown) for supporting the fixture in an elevated position while also providing electrical power to the fixture.

Figure 2:
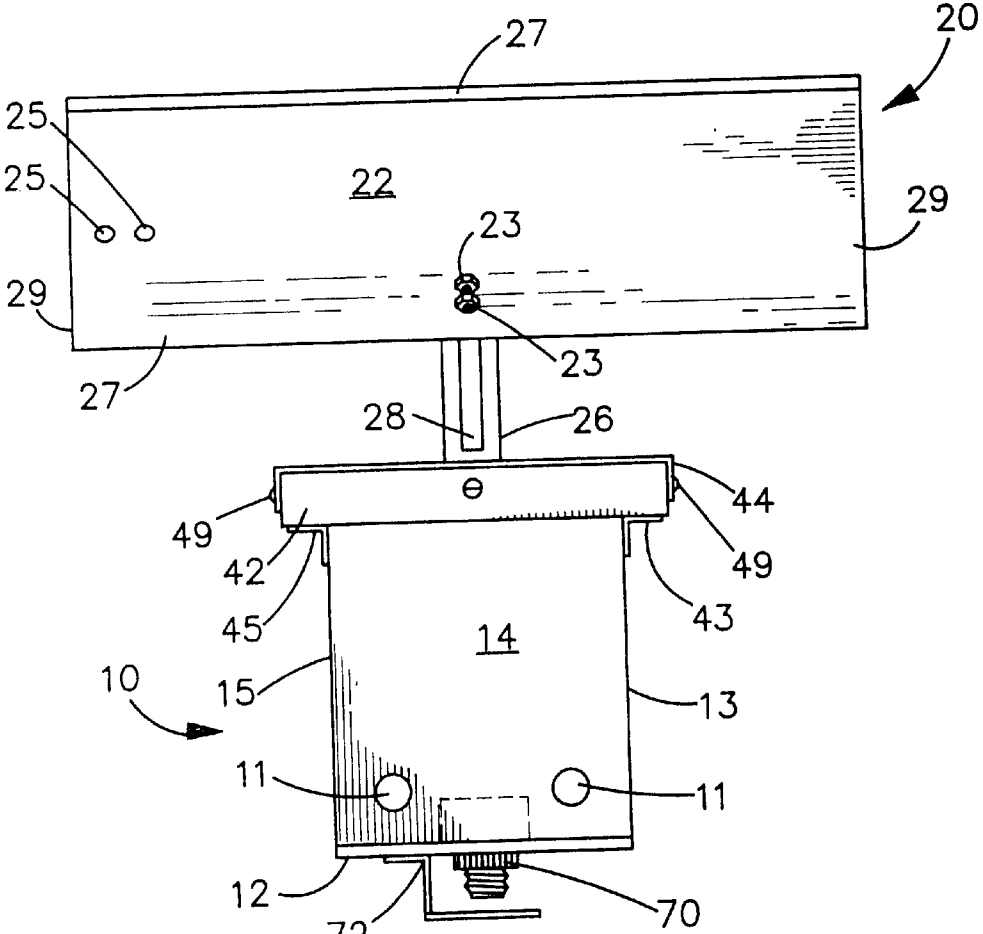
FIG. 2 is a side view partially in phantom of the device of FIG. 1.
Figure 4:
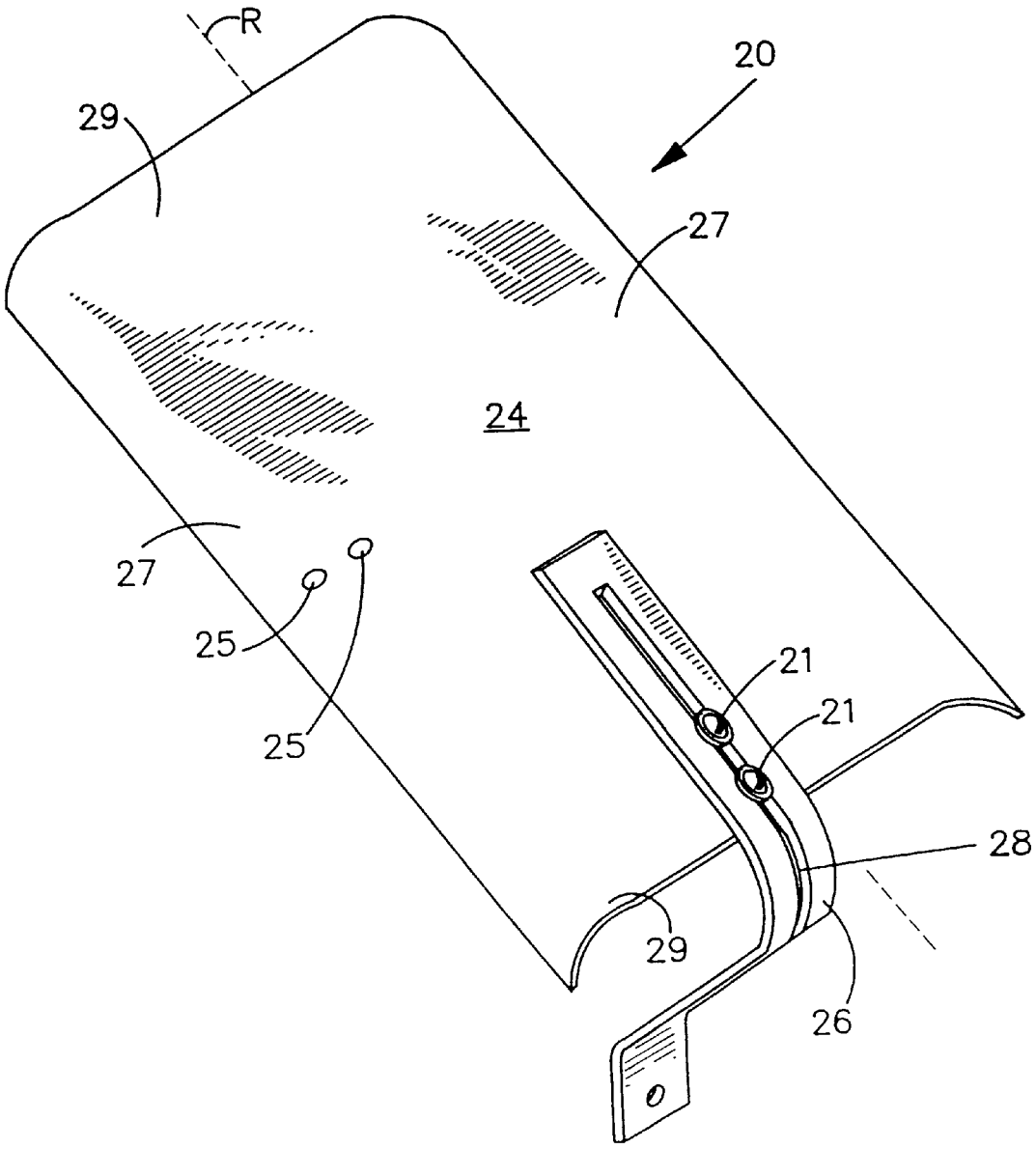
FIG. 4 is an elevated view in perspective of the reflector structure of the device of FIG. 1.

As may be seen from FIGS. 1, 2 and 4, reflector structure 20 is generally planar and rectangular in shape, and comprises a reflecting surface 22, a connecting surface 24, two length-defining side portions 27,27, and two width defining side portions 29,29. Each of side portions 27,27 is curved towards reflecting surface 22 to at least partially focus the direction of light reflection from surface 22. A support arm 26 defines an elongate aperture 28 and is connected to connecting surface 24 by a plurality of screws 21 and accompanying nuts 23, screws 21 extending through arm 26 at aperture 28 and through structure 20 at two respective apertures 25 (FIG. 4 only). Structure 20 defines additional apertures 25 which enable support arm 26 to be attached to structure 20 in at least two different ways (compare, e.g., FIGS. 1 and 4) so that structure 20 may be disposed above housing 10 in multiple ways to adjust the shape of the area in which light is cast from reflection by structure 20. Those of skill in the art will appreciate that this feature enables the device to be utilized in various settings which may require different patterns of light to be cast by the device onto an adjacent area, while still resisting damage by, for example, a would-be vandal.

The present invention has the added feature that the reflector structure of this invention is readily replaced if damaged through an act of vandalism which impinges upon its ability to reflect light emitted from the lamp. The reflector structure of this invention may be fabricated from a wide variety of materials, including, e.g., metal, armor plate, wood, reflective plastic, etc., and may take various other shapes, e.g., circular, square, triangular, etc., and generally should be shaped to maximized the amount of area which is effectively lighted by reflection of the light emitted from the lamp. In the preferred embodiment depicted, reflector structure 20 has an imaginary longitudinal axis R which is preferably longitudinally aligned with axis L of lamp 30 to efficiently enable the adjustable reflection of light from lamp 30 which passes through upper passageway 18 of housing 10. In this way, the amount of light effectively reflected by structure 20 is maximized. In the preferred embodiment depicted it will be appreciated that the position of reflector structure 20 is adjustable not only in this way, but also may be adjusted by bending support arm 26 so as to place surface 22 of structure 20 at a particular desired angle relative to the direction of light traveling through passageway 18, and/or by changing the attachment of structure 20 to arm 26 along the length of elongate aperture 28 so as to enable adjustment of the position of structure 20 relative to housing 10 and to further enable adjustment of the angle of surface 22 relative to the direction of light traveling through passageway 18. Thus, in the preferred embodiment depicted, support arm 26 should be sturdy enough to support structure 20 in a desired position during normal use of the device, yet malleable enough to be bent to adjust the spacial position of structure 20, as desired. Generally, the support arm may be fabricated from virtually any rigid solid material, including glass, wood, metal, plastic, etc., but preferably it will be fabricated from a resilient material which is resistant to weather damage and vandalism, e.g., a metal or a metal alloy.

This invention is susceptible to considerable variation in its practice. Therefore, the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

What is claimed is:

1. An armored light fixture which comprises:

a) an armored housing which defines an upper passageway through which light may pass, b) at least one lamp disposed within the armored housing, c) at least one reflector structure which is adjustable in position and which is disposed above the armored housing to enable the adjustable reflection of light which passes through the upper passageway of the armored housing.

2. An armored light fixture according to claim 1 wherein the armored housing comprises a side wall portion and a bottom portion, the side wall portion defining the upper passageway and being configured to receive a lamp cover lens which may be disposed across the upper passageway and above the lamp.

3. An armored light fixture according to claim 2 wherein the armored housing further comprises an armored flange extending upwardly from the side wall portion sufficiently to surround the outer perimeter of the lens when the lens is installed.

4. An armored light fixture according to claim 2 which further comprises a photocell for controlling the flow of electricity to the lamp based upon the amount of ambient light which is present.

5. An armored light fixture according to claim 4 wherein the lamp is an inert gas lamp.

6. An armored light fixture according to claim 5 wherein the lamp has an imaginary longitudinal axis which is substantially horizontally disposed when the fixture is installed, and wherein the position of the lamp may be adjusted so that the lamp is rotated about an imaginary vertical axis which is substantially perpendicular to the longitudinal axis when the fixture is installed.

7. An armored light fixture according to claim 6 wherein the armored housing further comprises an armored flange extending upwardly from the side wall portion sufficiently to surround the outer perimeter of the lens when the lens is installed.

8. An armored light fixture according to claim 7 wherein the armored housing defines one or more apertures therethrough so that air may circulate into and out of the housing during use of the fixture.

9. An armored light fixture according to claim 7 further comprising a removable screen which may be disposed above the lens when the lens is installed.

10. An armored light fixture according to claim 1 wherein the lamp has an imaginary longitudinal axis which is substantially horizontally disposed when the fixture is installed, and wherein the position of the lamp may be adjusted so that the lamp is rotated about an imaginary vertical axis which is substantially perpendicular to the longitudinal axis when the fixture is installed.

11. An armored light fixture according to claim 1 which further comprises a photocell for controlling the flow of electricity to the lamp based upon the amount of ambient light which is present.

12. An armored light fixture according to claim 11 which further comprises shielding means for shielding the photocell from one or more flying objects while concurrently permitting ambient light to reach the photocell.

13. An armored light fixture according to claim 12 wherein the shielding means comprises armor plate.

14. An armored light fixture according to claim 12 wherein the shielding means comprises bullet-resistant transparent material.

15. An armored light fixture according to claim 1 wherein the lamp is an inert gas lamp.

16. An armored light fixture according to claim 15 wherein the inert gas is halogen.

17. An armored light fixture according to claim 1 wherein the reflector structure has an imaginary longitudinal axis and is adjustable so that the imaginary longitudinal axis may be longitudinally aligned with the imaginary longitudinal axis of the lamp.

18. An armored light fixture which comprises:

a) An armored housing comprised of a side wall portion and a bottom portion, the side wall portion defining an upper passageway through which light may pass and being configured to receive a lamp cover lens which may be disposed across the upper passageway and above at least one halogen lamp disposed within the armored housing, the spacial position of the lamp within the armored housing being adjustable;

b) at least one reflector structure disposed above the armored housing and having an imaginary longitudinal axis, the reflector structure being adjustable so that the imaginary longitudinal axis may be longitudinally aligned with an imaginary longitudinal axis of the lamp to enable the adjustable reflection of light which passes through the upper passageway of the armored housing;

c) a photocell for controlling the flow of electricity to the lamp based upon the amount of ambient light which is present; and d) shielding means for shielding the photocell from one or more flying objects while concurrently permitting ambient light to reach the photocell.

19. An armored light fixture according to claim 18, wherein the shielding means comprises armor plate.

20. An armored light fixture according to claim 18, wherein the shielding means comprises a bullet-resistant transparent material.

* * * * *